US005981121A

United States Patent [19]

Ide

[11] Patent Number: 5,981,121

[45] Date of Patent: Nov. 9, 1999

[54] TRANSPARENT TONER USED IN COLOR IMAGE FORMING METHOD

[75] Inventor: Osamu Ide, Minami-Ashigara, Japan

[73] Assignee: Fuji Xerox Co., Ltd., Tokyo, Japan

[21] Appl. No.: 08/951,340

[22] Filed: Oct. 17, 1997

[30] Foreign Application Priority Data

Oct. 21, 1996 [JP] Japan ..... 8-277909

[51] Int. Cl.[6] ..... G03G 13/01

[52] U.S. Cl. ..... 430/45; 430/47; 430/124; 427/201; 427/197

[58] Field of Search ..... 430/45, 47, 124; 427/201, 197

[56] References Cited

U.S. PATENT DOCUMENTS

| | | | |
|---|---|---|---|
| 5,122,843 | 6/1992 | Yokoyama et al. | 430/45 |
| 5,300,383 | 4/1994 | Tsubota et al. | 430/45 |
| 5,506,671 | 4/1996 | Buts et al. | 430/45 |
| 5,660,959 | 8/1997 | Moriyama et al. | 430/45 |

FOREIGN PATENT DOCUMENTS

| | | |
|---|---|---|
| 324192 | 7/1989 | European Pat. Off. . |
| 63-58374 | 3/1988 | Japan . |
| 63-92964 | 4/1988 | Japan . |
| 63-92965 | 4/1988 | Japan . |
| 63-259575 | 10/1988 | Japan . |
| 63-300254 | 12/1988 | Japan . |
| 1-142740 | 6/1989 | Japan . |
| 3-2765 | 1/1991 | Japan . |
| 4-204669 | 7/1992 | Japan . |
| 4-204670 | 7/1992 | Japan . |
| 4-278967 | 10/1992 | Japan . |
| 5-142963 | 6/1993 | Japan . |
| 5-232840 | 9/1993 | Japan . |
| 6-148935 | 5/1994 | Japan . |
| 7-72696 | 3/1995 | Japan . |

*Primary Examiner*—Christopher D. Rodee
*Attorney, Agent, or Firm*—Oliff & Berridge, PLC

[57] ABSTRACT

A color image forming method of the present invention includes at least an image forming step in which a color image formed by a transparent toner with at least one kind of fine particles of 5 to 30% by volume being contained in a binding resin and a color toner is formed on a transfer material and a heat-fixing step for heating and fixing the color image onto the transfer material. As a result, graininess, color reproducibility, smoothness, and fixing strength are synchronously fulfilled sufficiently without being deteriorated and an arbitrary glossiness can be uniformly reproduced on the transfer material without depending on image density.

11 Claims, 2 Drawing Sheets

TRANSPARENT TONER USED IN COLOR IMAGE FORMING METHOD

BACKGROUND OF THE INVENTION

1. Field of the Invention

The present invention relates to a transparent toner which is used when a color image is formed by an electrophotographic system, an electrostatic recording system, or the like, and a method and apparatus for forming a color image. More particularly, the present invention relates to a transparent toner, a color image forming method, and a color image forming apparatus, in which graininess, color reproducibility, smoothness, and fixing strength are sufficiently fulfilled synchronously without being deteriorated and an arbitrary glossiness can be uniformly reproduced on a transfer material without depending on image density.

2. Description of the Related Art

Conventionally, a color image is formed on a transfer material (i.e., a color copy is obtained) by an electrophotographic system or the like in such a manner as described below. First, light is applied onto an original. The light reflected by the original is separated into multiple colors by a color CCD, is subjected to image processing by an image processing apparatus, and is further subjected to color correction so as to obtain image signals of multiple colors. The image signals are made into laser light modulated by using, for example, a semiconductor laser for each color. The laser light is irradiated on an inorganic photosensitive material such as selenium (Se) and amorphous silicon, or on an organic photosensitive material in which a phthalocyanine pigment, bis-azo pigment, or the like is used for a charge generating layer, a plurality of times (i.e., one color at a time) so as to allow formation of a plurality of electrostatic latent images. The plurality of electrostatic latent images are developed sequentially by using, for example, four color toners of Y (yellow), M (magenta), C (cyan), and K (black). The developed color toner images are transferred from the inorganic or organic photosensitive material onto a transfer material such as paper and are heated and fixed thereon by a heat-fixing roll or the like. As a result, a color image is formed on the transfer material.

Meanwhile, in the above-described case, the color toner is, for example, prepared with a colorant being dispersed in a binding resin such as polyester resin, styrene/acrylic copolymer, and styrene/butadiene copolymer and an average particle diameter of the color toner is approximately 1 to 15 $\mu$m. Fine particles each having the average particle diameter of approximately 5 to 100 nm, for example, inorganic fine particles such as silicon oxide, titanium oxide, and aluminium oxide, or fine resin particles such as PMMA and PVDF adhere to the surface of the color toner. Further, examples of the yellow colorant include bendizine yellow, quinoline yellow, and hanza yellow and examples of the magenta colorant include rhodamine B, rose bengal, and pigment red. Examples of the cyan colorant include phthalocyanine blue, aniline blue, and pigment blue and examples of the black colorant include carbon black, aniline black, and a blend of color pigments.

The surface of the color image formed as described above is made smooth during heat-fixing processing, and therefore, the color image has a glossiness which is different from that of the surface of a paper. Further, it has been known that the viscosity of the color toner during the heat-fixing processing varies depending on the kind of the binding resin contained in the color toner and the type of heat-fixing system, and the glossiness of the obtained color image thereby varies.

On the other hand, the preferable degree of glossiness of the color image widely varies depending on the types of images, the purposes for use, and the like. In the case of a photographic original of a human figure or landscape, a high-glossy image is generally preferable from the viewpoint of obtaining a sharp image. For example, Japanese Patent Application Laid-Open (JP-A) Nos. 5-142963, 3-2765, and 63-259575 each disclose that a high-glossy image is obtained by using a color copying machine and by selecting the materials of the toner and the fixing conditions. However, in this case, although the glossiness of an image portion obtained by the toner can be made higher, the glossiness of a non-image portion cannot be made higher. As a result, the glossiness on the transfer material cannot be made uniform. Further, even a character image by which low glossiness is desired is brought into the state of high glossiness and the glossiness cannot be arbitrarily selected.

In order to solve the above-described drawbacks, Japanese Patent Application Laid-Open (JP-A) Nos. 4-204669, 1-142740, and 63-300254 each disclose that by changing the characteristics of the binding, resins in the color toner and in the black toner, a black image (black character) is provided to have a low glossiness and a color image is provided to have a high glossiness. However, in this case, although only the black image (black character) can be brought into low glossiness, the glossiness of a color image or a color character cannot be arbitrarily controlled. Further, the glossiness on the transfer material cannot be made uniform as is the above case.

In the case of a color image obtained by a color copying machine, as compared with an image obtained by printing or silver-salt photography, a low-glossy image has an irregularly roughened surface and irregular reflection occurs on the surface of the color image. For this reason, even if a high-dispersion pigment or a small-particle-diameter toner is used, graininess, glossiness, and color tone become deteriorated. Further, in the color image obtained by a color copying machine, the glossiness thereof varies widely depending on the density of the image, and therefore, glossiness, graininess, and color tone are each different between a background portion (a non-image portion) and a low-density portion and between the background portion and a high-density portion and a finished image gives a feeling of unnaturalness having no smoothness as compared with the image obtained by printing or silver-salt photography.

Accordingly, in order to solve these problems caused by the glossiness, it has been proposed that by changing a fixing speed, a fixing temperature, a fixing pressure, or a fixing system when a toner image is fixed onto a transfer material, the glossiness of a color image is arbitrarily changed. However, in the case of the above fixed image, the fixing strength in a low-glossy image cannot be sufficiently obtained, and when abraded or folded, the image is impaired extremely. Further, in the case of a high-glossy image, binding resin permeates into the transfer material and sufficient glossiness cannot be obtained accordingly.

In order to avoid the above-described phenomena, an increase in molecular weight of the binding resin in the toner, an increase of cross linking component, or broadening of molecular weight distribution is disclosed in, for example, Japanese Patent Application Laid-Open (JP-A) No. 6-148935. However, in this case, although the fixing strength in the low-glossy image can be sufficiently realized, the high-glossy image cannot be sufficiently obtained. In other words, there exists a drawback in that it is difficult to synchronously fulfill the following objects: to obtain sufficient fixing strength in a fixed image; to obtain a high-glossy fixed image; and to prevent the binding resin from excessively permeating into the transfer material so that the state of the surface of the transfer material does not appear on the image surface. Further, in this case, each glossiness of a background portion (a non-image portion) and a low-density portion depends on the kind of the transfer material, and therefore, the glossiness on the transfer material cannot be made uniform as in the above case.

On the other hand, in order to solve the problem about the difference in glossiness caused by image density, for example, Japanese Patent Application Laid-Open (JP-A) Nos. 63-58374, 4-278967, 4-204670, 7-72696, and 5-232840 each disclose a method in which in addition to color toners, a transparent toner is transferred onto and fixed on a transfer material. Further, Japanese Patent Application Laid-Open (JP-A) Nos. 63-92964 and 63-92965 each disclose a method in which transparent resin is previously applied onto a transfer material. However, in these methods, although a uniform glossiness can be obtained without depending upon image density, under the condition that a binding resin in a toner does not permeate into the transfer material and the fixing strength of a fixed image is sufficiently obtained, the glossiness of the color image is necessarily and univocally determined in accordance with the characteristics of the binding resin contained in the toner.

On the other hand, Japanese Patent Application Laid-Open (JP-A) No.4-204670 discloses that transparent toners containing a plurality of kinds of binding resins having different molecular weights are used and at least one of the transparent toners is transferred onto and fixed on a color image so as to form an image having a different glossiness thereon. In this case, developing machines are required by the number of various glossiness. However, the number of developing machines is actually limited and it is therefore difficult to obtain an arbitrary glossiness. Further, installation of a toner supply device or a developing machine requires an additional space, and therefore, the entire apparatus is made larger unnecessarily. Moreover, since a plurality of kinds of binding resins having different molecular weights is used, it is difficult to control an amount of charge and it is thereby impossible to obtain a stable amount of development. In addition, there also exist drawbacks in that binding resins having a large molecular weight for obtaining a low glossiness are generally inferior in productivity and the fixing temperature thereof becomes higher.

Accordingly, under the existing circumstances, there has not been provided a color image forming technique in which graininess, color reproducibility, smoothness, and fixing strength in a color image can be fulfilled synchronously and sufficiently and glossiness of the color image can be controlled arbitrarily without depending on image density.

Accordingly, the present invention intends to solve the above-described problems in the prior arts and to achieve the following object. In other words, it is the object of the present invention to provide a color image forming method and a color image forming apparatus, in which graininess, color reproducibility, smoothness, and fixing strength are fulfilled synchronously and sufficiently without being deteriorated and an arbitrary glossiness can be uniformly reproduced on a transfer material without depending on image density.

SUMMARY OF THE INVENTION

As the result of the present inventors' deliberate examination for achievement of the above-described object, it has been found that by using, in addition to a color toner, a transparent toner containing 5 to 30% by volume of inorganic or organic fine particles and by causing the transparent toner to be at least transferred and fixed onto a non-image portion other than an image portion formed by the color toner, glossiness of a color image can be varied arbitrarily and a color image can be obtained which has a uniform glossiness without depending on image density and has a sufficient fixing strength. Further, it has be found that the above-described effects can also be easily achieved by changing at least one of fixing speed, fixing pressure, length of a fixed region, fixing system, and fixing temperature during a process in which the color image is heated and fixed on the transfer material.

The present invention has been provided based on the above-described views by the present inventors.

The means for solving the above-described problems are as follows.

The first means is a transparent toner in which at least one kind of fine particles of 5 to 30% by volume is contained in a binding resin.

The second means is a color image forming method which includes at least an image forming step in which a color image formed by a color toner and a transparent toner with at least one kind of fine particles of 5 to 30% by volume being contained in the binding resin is formed on a transfer material and a heat-fixing step in which the color image is heated and fixed on the transfer material.

The third means is a color image forming apparatus which includes at least developing means for developing a color image formed by a transparent toner and a color toner on a transfer material and heat-fixing means for heating and fixing the color image on the transfer material, wherein the heat-fixing means can control glossiness of the color image.

DESCRIPTION OF THE PREFERRED EMBODIMENTS

Figure 1:
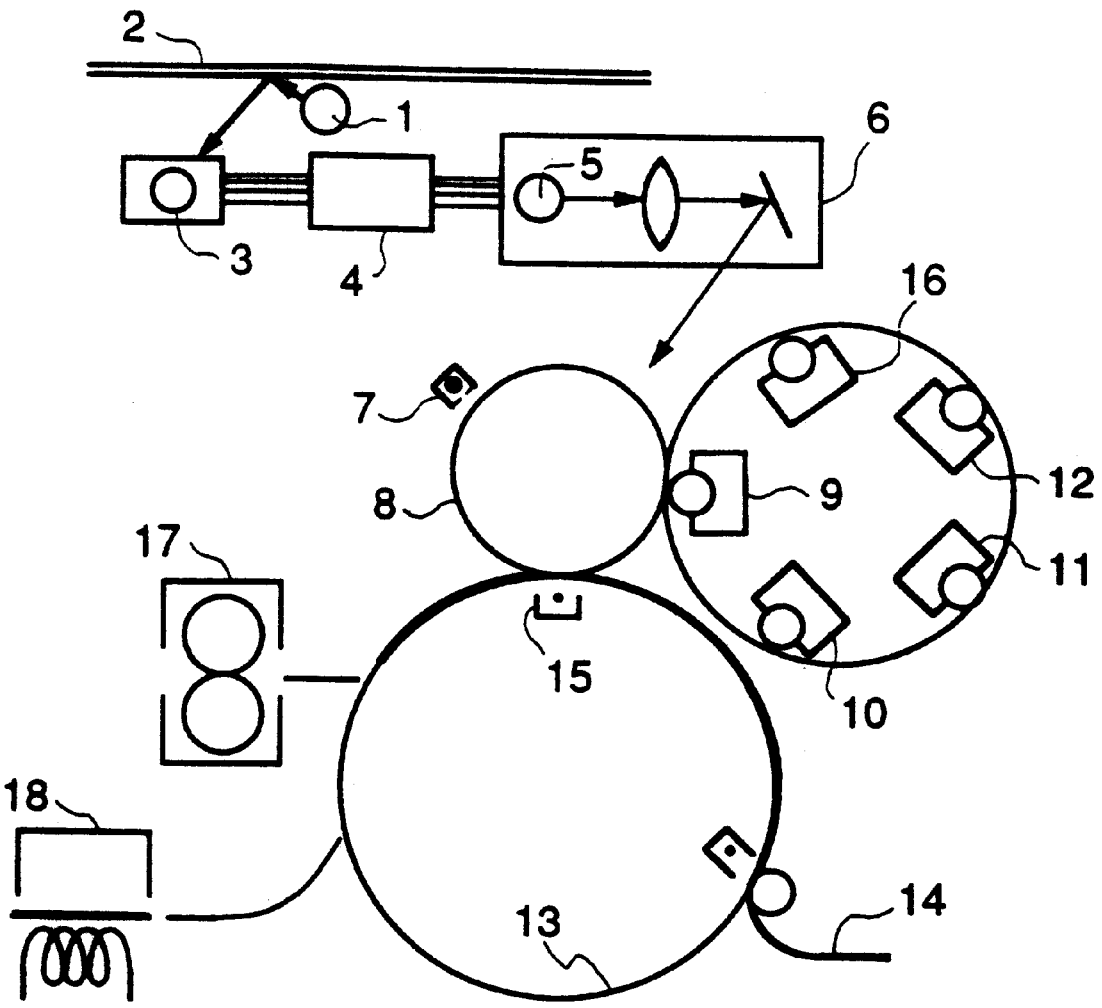
FIG. 1 is a schematic diagram for illustrating an example of a color image forming apparatus according to the present invention.

A color image forming method according to the present invention includes at least an image forming step with a transparent toner of the present invention used and a heat-fixing step. These steps will be hereinafter described in detail. Meanwhile, the color image forming method of the present invention can be implemented appropriately by using a color image forming apparatus of the present invention, which will be described later. The color image forming apparatus of the present invention includes at least developing means and heat-developing means.

[IMAGE FORMING STEP]

The image forming step is a step in which a color image is formed on a transfer material by using a transparent toner of the present invention, which will be described later, and also using color toners.

This image forming step is not particularly limited except that the transparent toner of the present invention and color toners are used, and includes known charging, image exposure, developing, and transfer operations. Further, other operation, for example, a pre-transfer charging operation may be also performed as occasion demands.

Transparent toner

The transparent toner of the present invention contains a binding resin and fine particles. The fine particles are contained in the transparent toner in such a manner as to be dispersed in the binding resin. The transparent toner has various characteristics such as frictional property and charging property, which are similar to those of an ordinary color toner.

In the present invention, the "transparent toner" means toner particles which do not contain color materials used for coloring by light absorption or light scattering (for example, a coloring pigment, a coloring dye, black carbon particles, and black magnetic particles). The transparent toner of the present invention is usually colorless and transparent. Although the transparency of the toner may become slightly low depending on the kind or amount of fine particles contained in the toner, the transparent toner is substantially colorless and transparent.

It suffices that the binding resin is substantially transparent, and the binding resin can be appropriately selected depending on the purpose. Examples of the binding resin include known resins used for an ordinary toner, for example, a polyester resin, a polystyrene resin, a polyacrylic resin, other vinyl-containing resin, a polycarbonate resin, a polyamide resin, a polyimide resin, an epoxy resin, and a polyurea resin. Among these resins, polyester resins are preferable from the viewpoint in that toner characteristics such as low-temperature fixing property, fixing strength, and preservation property can be fulfilled synchronously.

As the above-described fine particles, inorganic fine particles and organic fine particles are used.

The material used for the inorganic fine particles is not specifically limited so long as the effects of the present invention are not impaired and thus it can be selected optionally according to the purpose. For example, silica, titanium dioxide, stannic oxide, and molybdenum oxide are used. Meanwhile, in the present invention, by taking dispersibility of the inorganic fine particles in the binding resin into consideration, the inorganic fine particles may be subjected to a surface reforming process by using a silane coupling agent, a titanium coupling agent, and the like.

The material used for the organic fine particles is not specifically limited so long as the effects of the present invention are not impaired and thus it can be selected optionally according to the purpose. For example, a polyester resin, a polystyrene resin, a polyacrylic resin, a vinyl resin, a polycarbonate resin, a polyamide resin, a polyimide resin, an epoxy resin, a polyurea resin, and a fluorine-containing polymer are used. Meanwhile, in the present invention, by taking dispersibility of the organic fine particles in the binding resin into consideration, the organic fine particles may be subjected to a surface reforming process by employing a reaction of graft polymerization.

An amount of the above-described fine particles added in the transparent toner, R, (i.e., an amount of the fine particles added to the binding resin) is 5 to 30% by volume, preferably 8 to 20% by volume. Further, the amount of the fine particles added is preferably set in the range in which any one of lowest limit values in the above numerical ranges or an amount of the added fine particles employed in an embodiment described below is set as the lower limit and any one of upper limit values in the above numerical ranges or an amount of the added fine particles employed in an embodiment described below is set as the upper limit.

When the amount of the fine particles added is less than 5% by volume, sufficient fixing strength required for a low-glossy image and sufficient glossiness required for a high-glossy image cannot consist together. On the other hand, when the amount of the added fine particles exceeds 30% by volume, sufficient glossiness required for the high-glossy image cannot be obtained.

The average particle diameter (d) of the fine particles is preferably 0.008 to 1.0 $\mu$m, more preferably 0.01 to 0.1 $\mu$m. When the average particle diameter exceeds 1.0 $\mu$m, color reproducibility, glossiness, and fixing strength cannot be synchronously fulfilled depending on the fixing conditions. Further, the transparency of the toner decreases and desired color reproducibility cannot be obtained accordingly. Further, the average particle diameter is less than 0.008 $\mu$m, flocculation of the fine particles is caused and the transparent toner in which the fine particles are uniformly dispersed cannot be obtained. As a result, an image thus obtained has a deteriorated color reproducibility and a reduced fixing strength. On the other hand, when the average particle diameter of the fine particles is set in the above more preferable range, color reproducibility is excellent and variation in glossiness can be sufficiently achieved.

The difference in refractive index between the binding resin and the fine particles ($\Delta N$) is in the range of −0.3 to 0.3, namely, the absolute value thereof is preferably in the range of 0.0 to 0.3. When the absolute value of the difference in refractive index exceeds 0.3, it is disadvantageous in that light scattering occurs in the interface of the binding resin and the fine particles so that color reproducibility deteriorates. On the other hand, when the absolute value of the difference in refractive index is set in the above numerical range, it is advantageous in that excellent color reproducibility can be achieved.

In the present invention, given that the average particle diameter of the fine particles is indicated by d($\mu$m) and the amount of the fine particles added in the transparent toner is indicated by R (% by volume), it is preferable that the value of $R \times d^3$ for the transparent toner is set in the following range in the viewpoint of achievement of excellent color reproducibility.

$$10^{-5} \leqq R \times d^3 \leqq 0.15$$

In the present invention, given that the average particle diameter of the fine particles is indicated by d($\mu$m), the amount of the fine particles added in the transparent toner is indicated by R (% by volume), and the difference in refractive index between the binding resin and the fine particles is indicated by $\Delta N$, it is preferable that the value of $\Delta N^2 \times R \times d^3$ for the transparent toner is set in the following range in the viewpoint of achievement of excellent color reproducibility.

$$0 \leqq \Delta N^2 \times R \times d^3 \leqq 10^{-6}$$

Meanwhile, as a method for mixing and dispersing the fine particles in the binding resin, there is used a method used when an ordinary color toner is prepared, namely, a known dry process or wet process used when a charging control agent or a color pigment is mixed and dispersed in a binding resin. Among the above mixing and dispersing method, the dry process can be performed by employing, for example, a known kneading device of fusion-agitation type and the fine particles can be uniformly dispersed and mixed in the binding resin by the kneading device or the like. Further, the wet process can be performed by employing, for example, a conventional wet polymerization process. After the fine particles are agitated and dispersed in a binding resin solution, transparent toner particles are granulated by a suspension dispersion, and by removing the solvent and drying, the transparent toner particles are prepared. In the transparent toner thus prepared, the fine particles are uniformly dispersed in the binding resin and the transparency of the toner is excellent.

The transparent toner is substantially colorless and transparent visually, but it may be slightly colored and transparent as occasion demands.

In order to uniformly obtain a desired glossiness in the above-described transparent toner, the flowing property and charging property of the transparent toner need to be controlled. From the viewpoint of controlling the flowing property and charging property of the transparent toner, the inorganic fine particles and/or organic fine particles are preferably externally added or adhered to the surface of the transparent toner.

The above-described inorganic fine particles are not specifically limited so long as the effects of the present invention are not damaged and thus it can be selected optionally from known fine particles used as external additives depending on the purpose. Examples of the material used for the fine particles include silica, titanium dioxide, stannic oxide, and molybdenum oxide. Further, by taking safety such as the charging property into consideration, the inorganic fine particles may be subjected to a hydrophobic process by using a silane coupling agent, a titanium coupling agent, and the like.

The above-described organic fine particles are not specifically limited so long as the effects of the present invention are not damaged and thus it can be selected optionally from known fine particles used as external additives depending on the purpose. Examples of the material used for the organic fine particles include a polyester resin, a polystyrene resin, a polyacrylic resin, and other vinyl-containing resin, a polycarbonate resin, a polyamide resin, a polyimide resin, an epoxy resin, a polyurea resin, and a fluorine-containing resin.

The average particle diameter of each of the inorganic fine particles and the organic fine particles is most preferably 0.005 to 1 $\mu$m. When the average particle diameter is less than 0.005 $\mu$m, flocculation is caused with the inorganic fine particles and/or the organic fine particles being adhered to the surface of the transparent toner and the desired effect cannot be obtained accordingly. Further, when the average particle diameter exceeds 1 $\mu$m, it is difficult to obtain an image having a higher glossiness.

In the present invention, given that the refractive index of the inorganic fine particles and/or the organic fine particles is n, the refractive index of the above-described binding resin is N, and the weight ratio of the inorganic fine particles and/or the organic fine particles to the binding resin is W, the value of $(n-N)\times W\times 100$ is preferably set for the inorganic fine particles and/or the organic fine particles in the range described below from the viewpoint of obtaining excellent color reproducibility.

$$-4 \leqq (n-N)\times W\times 100 \leqq 4$$

When the value of (n−N)'W×100 is set outside the above numerical range, light scattering becomes wide in the interface between the inorganic fine particles and/or the organic fine particles and the binding resin. Although the glossiness of the image surface is set in the desired range, an image which exhibits excellent color reproducibility cannot be formed.

In the present invention, the reason why a specific amount of the fine particles is contained in the transparent toner so that sufficient variation in glossiness is realized due to the change of heat-fixing conditions without the fixing strength to the transfer material being damaged is not completely made clear, but it is supposed that the aforementioned results from an increase in thixotropic property caused by addition of the fine particles. Namely, in the case of the transparent toner with the above-described fine particles added thereto, as compared with a transparent toner consisting of only binding resins, the effective viscosity of the toner during a heat-fixing step is apt to change due to the heat-fixing conditions. For this reason, it is supposed that the variation in glossiness becomes greater. The adhesive strength between the transfer material and the color image by the toner, or the adhesive strength between the toner particles after the heat-fixing step is determined by the properties of the binding resin itself, and therefore, even in the case of obtaining low glossiness, it is supposed that sufficient fixing strength can be obtained.

Color toner:

The above-described color toner includes at least a binding resin and a pigment, and a magenta (M) toner, a cyan (C) toner, a yellow (Y) toner, and a black (K) toner are provided. The composition and average particle diameter of the above color toner are selected appropriately from the range which fulfills the object of the present invention.

As for the binding resin, the above-described examples of the binding resins in the transparent toner can be used. The pigment is not particularly limited so long as it is a pigment ordinarily used as the toner pigment and thus it can be selected from the magenta pigment (M), cyan pigment (C), yellow pigment (Y), and black pigment (K), which are themselves known.

In the present invention, the above-described color toners may be prepared optionally or may be a commercial product.

Meanwhile, the above-described transparent toner and color toner are each used as a developing agent in such a manner as to be combined with a carrier which is appropriately selected and is itself known. Further, there may also be applied a method in which these toners are each provided as a one-component developing agent to allow frictional charging with a developing sleeve or a charging member to form a charging toner and then development processing is effected in accordance with an electrostatic latent image.

Various operations in the image forming step are effected as described below.

The above-described charging operation is an operation in which the surface of an electrophotographic photosensitive member is charged. For example, a contact charging process with a conductive or semi-conductive roller, brush, film, or rubber blade used, and a scorotron or corotron charging process with a corona discharge process employed. The above-described charging process can be performed by using a known charging device.

The image exposing operation is an operation in which the charged surface of the electrophotographic photosensitive member is exposed in imaging manner to form an electrostatic latent image thereon. This operation can be implemented by, for example, using a known image exposing device which employs a well-known light source such as LED light and liquid-crystal shutter light in addition to semiconductor laser light.

The above-described developing operation is an operation in which the electrostatic latent image is developed by using a toner to form a color image, and can be implemented by, for example, using a developing machine which allows development processing with the toner contacting or non-contacting. At this time, a developing method in which a carrier is used as a two-component developing agent or a developing method in which a carrier is used as a one-component developing agent can be applied. However, in the present invention, as for the toner, the following ones are used.

The above-described transfer operation is an operation in which the color image is transferred onto a transfer material. For example, a transfer operation using a corona discharge process and a contact transfer operation using a transfer belt or a transfer roller are used. The above transfer operation can be implemented by using a known transfer-charging device.

Meanwhile, the above-described transfer material is not particularly limited so long as it functions to retain the toner thereon to hold an image, and for example, a commercially available copy sheet which is itself known is used.

The above-described image forming process can be appropriately implemented by using developing means in the color image forming apparatus of the present invention. The developing means has a function of developing a color image on a transfer material by a toner and also includes an electrophotographic photosensitive member, a charging device, an image exposing device, a developing machine, a transfer-charging device, and the like. Further, the developing means may include other equipment, for example, a pre-transfer charging device as occasion demands.

The above-described electrophotographic photosensitive member is not particularly limited and known ones may be used. For example, a single-layer photosensitive member may be used or a multilayer photosensitive member of function-separated type may also be used.

As for the above-described charging device, there may be used a charging device which is itself known, such as a contact charging device with a conductive or semi-conductive roller, brush, film, or rubber blade used, and a scorotron or corotron charging device with a corona discharge process employed.

As the above-described image exposure device, for example, a known optical equipment is used in which a light source such as semiconductor laser light, LED light, or liquid-crystal shutter light is used to allow exposure of a desired image on the surface of the electrophotographic photosensitive member.

As the above-described developing machine, for example, a known developing machine is used which has a function of causing toner to adhere to the electrophotographic photosensitive member by using a brush, a roller, and the like. However, the developing machine in the color image forming apparatus of the present invention has a function of effecting development processing by using the transparent toner and the color toners (M, C, Y, and K). As for the above developing machine, for example, a developing machine is used with a transparent toner developing machine, a magenta toner (M) developing machine, a cyan toner (C) developing machine, and a yellow toner (Y) developing machine being provided at the circumferential portion of a rotating body.

As for the transfer-charging machine, for example, a known transfer-charging device such as a contact transfer-charging device using a transfer belt, a transfer roller, or the like, and a scorotron or corotron transfer-charging device employing a corona discharge process is used.

Formation of a color image on the transfer material by using the transparent toner and the color toners which are mixed with and charged by the known carrier can be implemented in accordance with a known method as described in Japanese Patent Application Laid-Open (JP-A) No. 63-58374. For example, an electrophotographic photosensitive member is, first, charged by the charging device. The electrophotographic photosensitive member is exposed by the image exposure device in imaging manner to allow formation of an electrostatic latent image thereon. The electrostatic latent image is developed by the developing machine equipped with the transparent toner and the color toners and a color image is thereby formed on the electrophotographic photosensitive member by the transparent toner and the color toner. Finally, the color image is transferred onto the transfer material. Alternatively, the color image may be formed by employing a developing method using a one-component developing agent having no carrier.

At this time, the color image formed on the electrophotographic photosensitive member may be directly transferred onto the transfer material or may be transferred thereon after having been temporarily transferred onto an intermediate transfer material.

The order in which the transparent toner and the color toner are transferred in the color image is not particularly limited and thus it can be selected optionally according to the purpose. For example, the transparent toner is, first, adhered to the electrophotographic photosensitive member or to the intermediate transfer material and charging and exposing processing is effected repeatedly thereon, and further, an image is developed by using the color toner. This operation is repeated by the number of the color toners, and after an image developed by a plurality of toners is formed on the electrophotographic photosensitive member, the plurality of toners may be transferred together onto the electrophotographic photosensitive member.

Further, after a image developed by the color toners is first transferred onto the transfer material, the transparent toner may be transferred to the color image on the transfer material. This operation will be hereinafter described in detail. First, an image is developed by using the color toners of cyan, magenta, yellow, and black. The image developed by these color toners is transferred onto the transfer material. Subsequently, the surface of the electrophotographic photosensitive member is subjected to charging processing and is exposed entirely by ROS, and the transparent toner is applied onto the entire surface of the electrophotographic photosensitive member by using the developing machine to form a transparent layer thereon. The transparent layer is entirely applied onto an image of the color toner transferred onto the transfer material. At this time, the transparent layer formed by the transparent toner may be applied onto only a background portion (white-colored portion) of the image without being entirely applied onto the image of the color toners. In this case, after only the portion of the electrophotographic photosensitive member corresponding to the background portion is subjected to charging and exposure processing, the transparent toner is applied onto the electrophotographic photosensitive member by using the developing machine and the transparent layer is thereby formed by the transparent toner.

In the above-described cases, the transparent layer of the transparent toner is formed on the outermost layer of the color image transferred onto the transfer material.

[HEAT-FIXING STEP]

The above-described heat-fixing step is a step in which the color image formed on the transfer material in the image forming step is heated and fixed on the transfer material.

The heat-fixing step includes a heat-fixing operation, and further includes other operations as occasion demands. The heat-fixing step can be performed in accordance with a known method. In the present invention, at least one of various conditions provided during the heat-fixing process is appropriately varied, and although only one developing machine for developing the transparent toner is provided, there is no possibility that the fixing strength is impaired and image quality deteriorates due to permeation of an excess toner into the transfer material. Further, it is preferable that the glossiness of a color fixed image to be obtained is arbitrarily controlled to allow setting of a plurality of levels of glossiness.

The various conditions required during the heat-fixing step includes, for example, fixing speed, fixing pressure, length of fixed region, fixing system, and fixing temperature. A preferable range of each of the above conditions varies depending on the kind of the toner and the material used for the transfer material, and therefore, cannot be provided unconditionally and is selected optionally in the range which does not impair the effects of the present invention. The relation between the glossiness of a color fixed image and each of the various conditions required during the heat-fixing step will be, for example, described hereinafter.

The relation between the fixing speed and the glossiness of the color fixed image is set such that the fixing speed is increased to obtain a low glossiness and the fixing speed is decreased to obtain a high glossiness.

The relation between the fixing pressure and the glossiness of the color fixed image is set such that the fixing pressure to be applied in the fixed region is decreased to obtain a low glossiness and the fixing pressure to be applied in the fixed region is increased to obtain a high glossiness.

The relation between the length of a fixed region and the glossiness of the color fixed image is set such that the fixed region is made longer to obtain a low glossiness and the fixed region is made shorter to obtain a high glossiness.

The relation between the fixing system and the glossiness of the color fixed image is set such that an oven or radiant fixing device which allows non-contact heating/fixing processing is used to obtain a low glossiness and a heating roll fixing device is used to obtain a high glossiness.

The relation between the fixing temperature and the glossiness of the color fixed image is set such that the fixing temperature is decreased to obtain a low glossiness and the fixing temperature is increased to obtain a high glossiness.

A method for changing the fixing speed can be selected optionally according to the purpose, and for example, a method for changing the number of rotation of a fixing roll is used.

A method for changing the fixing pressure can be selected optionally according to the purpose, and for example, a method for changing spring constant of a spring for determination of pressure between a fixing roll and a pressure roll opposite thereto, and a method for changing an amount by which the fixing roll deforms by changing the distance between the fixing roll and the pressure roll are used. Meanwhile, the above-described method for changing the number of rotation of the fixing roll and method for changing the fixing pressure are given as examples and the present invention needs not to be limited to the same.

As for a method for changing the length of the fixed region, for example, a method using fixing rolls having different rigidities and a method for changing the fixing pressure are used.

As for a method for changing the fixing system, for example, a method in which in fixing means having different types of fixing devices, these fixing devices are appropriately switched is used.

As for a method for changing the fixing temperature, for example, a method for changing a set temperature in a fixing device having a heating function is used.

The heat-fixing step can be appropriately performed by employing heat-fixing means in the image forming apparatus of the present invention. The above-described heat-fixing means has at least functions of allowing the color image to be heated and fixed on the transfer material and controlling the glossiness of the color image. When the heat-fixing means has the above functions and operates to form the color image by using the above-described transparent toner and color toner, it is advantageous in that the glossiness of the color image formed on the transfer material can be appropriately controlled in a desired range.

The above-described former function is a function in which color toners on the transfer material is molten to be fixed on the transfer material at a proper fixing strength by the heat-fixing means. The above-described latter function is a function which can arbitrarily change at least one of the conditions such as the fixing speed, the fixing pressure, the length of fixed region, the fixing system, and the fixing temperature. Meanwhile, in the case of the latter function, setting may be automatically varied by using control equipment such as a computer, or setting may also be appropriately varied manually or by a manual input operation.

As for the heat-fixing means having the above-described functions, for example, a system in which a plurality of fixing devices are provided so as to be exchangeable according to the purpose is preferably used. More specifically, the heat-fixing means preferably includes a fixing roll, an oven fixing device, and a radiant fixing device and at least any one of these devices can be used in such a manner as to be appropriately exchanged, and the fixing roll is provided such that the fixing speed, fixing pressure, length of fixed region, and fixing temperature thereof can be optionally set and varied.

Next, the color image forming method of the present invention to be implemented by using the color image forming apparatus of the present invention will be described with reference to the attached drawings.

FIG. 1 is a schematic diagram for illustrating an example of the color image forming apparatus of the present invention.

The color image forming apparatus shown in FIG. 1 includes image forming means and heat-fixing means. The image forming means further includes a charging device 7 serving as the above-described charging device, an organic photosensitive member 8 serving as the above-described electrophotographic photosensitive member, an illumination 1, a color CCD 3, an image processor 4, a laser diode 5, and an optical system (ROS) 6, which serve as the above-described image exposure device, an yellow (Y) developing machine 9, a magenta (M) developing machine 10, a cyan (C) developing machine 11, a black (K) developing machine 12, and a transparent toner developing machine 16, which serve as the above-described developing machine, and a transfer corotron 15 serving as the above-described transfer charging device, the transfer corotron 15 being disposed toward the organic photosensitive member 8 via a transfer drum 13. The heat-fixing means includes, as fixing devices, a heat roll fixing device 17 and an oven fixing device 18.

In the above-described color image forming apparatus, the heat roll fixing device 17 and the oven fixing device 18 can be appropriately exchanged and each heat-fixing temperature of the heat roll fixing device 17 and the oven fixing device 18 can be varied. Further, the rotating speed, contact pressure, contact length, and quality of material used for the surface layer of a pair of rolls in the heat roll fixing device 17 are each designed to be variable.

When a color copy is obtained by using the color image forming apparatus shown in FIG. 1, light from the illumination 1 is, first, applied onto an original from which a copy is obtained, and light reflected by the original 1 is separated into colors by the color CCD 3 and is subjected to image processing and color correction in the image processor 4. Subsequently, the obtained image signals of multiple colors are made into laser light modulated by using the laser diode 5 for each of the colors. The laser light is applied onto the organic photosensitive member 8 a plurality of times (i.e., one color at a time) so as to form a plurality of electrostatic latent images thereon. The plurality of electrostatic latent images are developed sequentially in the yellow (Y) developing machine 9, the magenta (M) developing machine 10, the cyan (C) developing machine 11, the black (K) developing machine 12, and the transparent toner developing machine 16 by using the four color toners of Y, M, C, and K and the transparent toner, respectively. The developed color toner image is transferred from the organic photosensitive member 8 onto the transfer material 14 such as paper and is heated and fixed thereon by the heat roll fixing device 17. As a result, a color image is formed on the transfer material 14. Meanwhile, the transparent layer formed by the transparent toner exists on the outermost surface of the color image.

Figure 2:
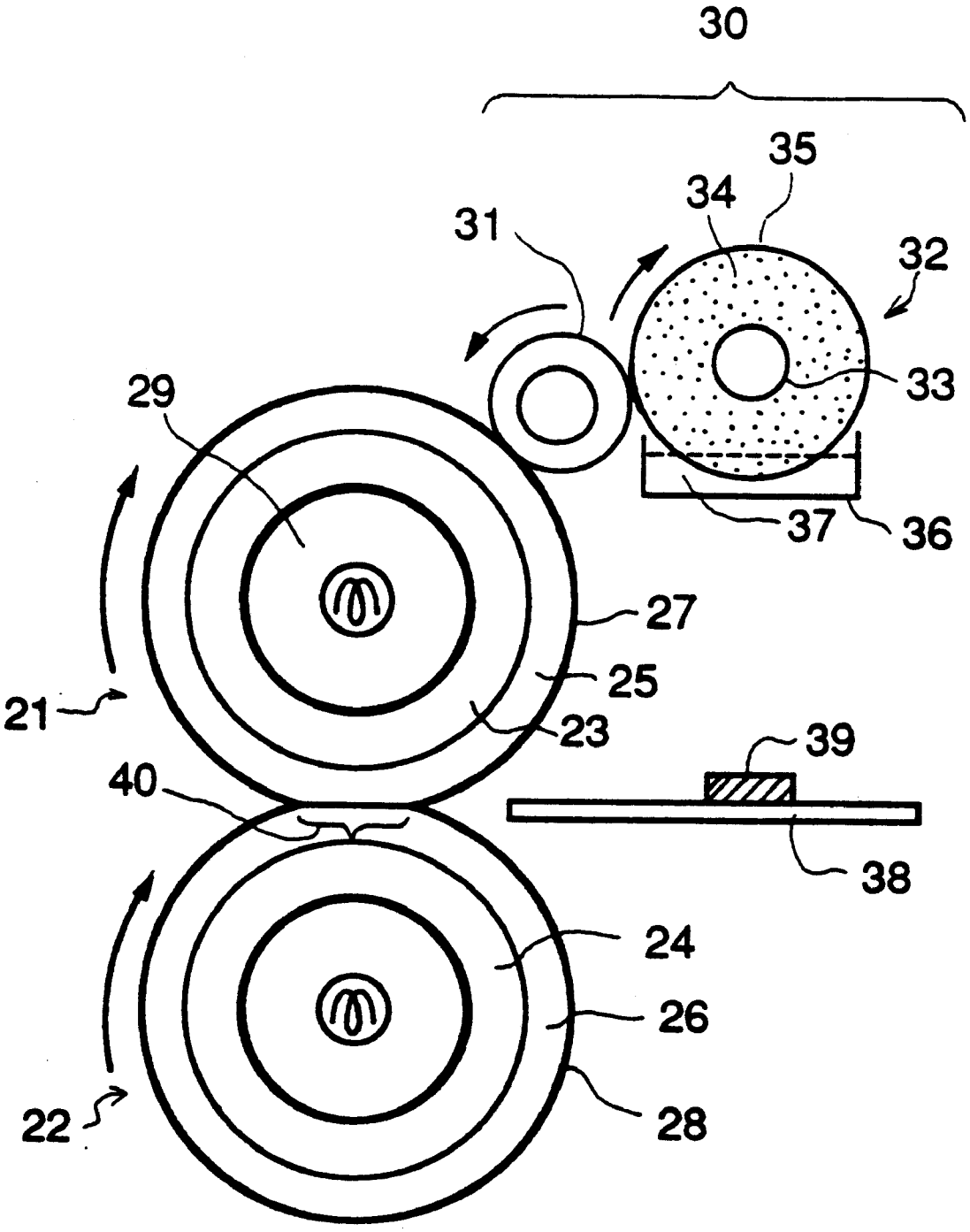
FIG. 2 is a schematic diagram for illustrating an example of heat-fixing means in the color image forming apparatus according to the present invention.

The heat-fixing operation will be hereinafter described with reference to FIG. 2. FIG. 2 is a schematic diagram for illustrating an example of the heat-fixing means in the color image forming apparatus of the present invention. The heat-fixing means is the heat roll fixing device 17. The pair of rolls in the heat roll fixing device 17 is a fixing roll 21 and a pressure roll 22. The fixing roll 21 has a heat source 29 incorporated therein. Further, a mold release agent supplying roll 31 abuts against the surface of the fixing roll 21 in rotatable manner from the viewpoint of application and supply of a mold release agent for the surface of the fixing roll 21. A mold release agent supplying roll 32 abuts against the mold release agent supplying roll 31 and a mold release agent 36 is supplied for the surface of the fixing roll 21 by the mold release agent supplying roll 32.

In the heat-fixing means, a transfer material 38 onto which a color toner image 39 to be heated and fixed is transferred is supplied for an interface where the fixing roll 21 and the pressure roll 22 contact each other. The color toner image 39 is pressed by the fixing roll 21 and the pressure roll 22. At this time, due to heat of the heat source 29 contained in the fixing roll 31, the binding resin in each of the toners used for forming the color toner image 39 is molten and is fixed on the transfer material 38 at a sufficient fixing strength. Meanwhile, in the heat-fixing means, various conditions provided for the heat-fixing step can be appropriately varied, and therefore, the glossiness of a color fixed image to be obtained can be controlled so as to be appropriately varied at a desired degree.

Next, examples of the present invention will be described. However, the present invention is not limited to the same.

[EXAMPLE 1-1]

Color toner

As for a color toner to be used in the following examples, a cyan toner, a magenta toner, an yellow toner, and a black toner for A-color manufactured by Fuji Xerox Co., Ltd. were used.

Transparent toner A:

The transparent toner A contains 85% by volume of a binding resin and 15% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polymethylmethacrylate, average particle diameter is 0.3 $\mu$m, refractive index is 1.5).

The above-described binding resin and fine particles were molten and mixed by employing an extruder and grained by employing a jet mill, and further, classified by employing a pneumatic classifier. As a result, the transparent toner A (d50 is 7 $\mu$m) was prepared.

The following two types of inorganic fine particles A, B were adhered to 100 parts by weight of the transparent toner A by employing a high-speed mixer. The inorganic fine particle A is silicon dioxide ($SiO_2$), which was prepared in such a manner that the surface thereof is subjected to hydrophobic processing with a silane coupling agent (average particle diameter is 0.05 $\mu$m, refractive index is 1.4, amount to be added is 1.1 parts by weight). The inorganic fine particle B is titanium dioxide ($TiO_2$) which was prepared in such a manner that the surface thereof is subjected to hydrophobic processing with a silane coupling agent (average particle diameter is 0.02 $\mu$m, refractive index is 2.5, amount to be added is 1.4 parts by weight).

Developing agent

As for a carrier used together with the above-described toner, spherical ferrite particles were used which are coated with styrene methylmethacrylate copolymers and which have an average particle diameter of approximately 50 $\mu$m. The color toners and the transparent toner were each added at the rate of 8 parts by weight to 100 parts by weight of the carrier and mixed by employing a tabler shaker mixer, and thus a two-component developing agent was prepared.

Formation of color image

As for the image forming apparatus, modified A-color 630 manufactured by Fuji Xerox Co., Ltd. was employed. This is the same as the above-de scribed color image forming apparatus shown in FIG. 1 The operation of the color image forming apparatus shown in FIG. 1 has been already described. Further, the heat roll fixing device 17 is also the same as the heat-fixing means shown in FIG. 2. The operation of the heat-fixing means has also been already described.

In FIG. 2, the fixing roll 21 is pressed by an unillustrated spring in the direction along the axial core of the pressure roll 22 and the pressure roll 22 is fixed to a main body of the apparatus. A fixing-roll elastic layer 25 and a pressure-roll elastic layer 26, which are each formed of silicon rubber having a thickness of 2 mm, are provided on the surfaces of the fixing roll 21 and the pressure roll 22, respectively. A fixing roll core 23 and a pressure roll core 24 are provided inside the fixing-roll elastic layer 25 and the pressure-roll elastic layer 26, respectively. A fixing-roll mold release layer 27 and a pressure-roll mold release layer 28 are provided outside the fixing-roll elastic layer 25 and the pressure-roll elastic layer 26, respectively. A fluorine-containing rubber is used for each of the above mold release layers. The mold release agent supplying device 30 is used to apply a mold release agent (silicon oil) onto the surface of the fixing roll 21 and includes mold release agent supplying rolls 31, 32, a core metallic portion 33, a rubber elastic body 34, a porous film 35, a mold release agent storing tank 36, and a mold release agent 37. A roll nip range 40 indicates the length of fixed region.

The elastic bodies 25, 26 in the fixing roll 21 and the pressure roll 26 each have a thickness of 2 mm, impact resilience of 70%, and rubber hardness of 60 degrees. Further, the mold release layers 27, 28 each have a thickness of 40 $\mu$m. The fixing temperature was set at 150° C. The speed at which the paper passes through the interface between the fixing roll 21 and the pressure roll 22, i.e., the fixing speed was set at 160 mm/second. Further, as for the transfer material 38 used for measurement, "J" paper manufactured by Fuji Xerox Co., Ltd. was used. The roll nip range, i.e., the length of a fixed region was set at 6 mm. Further, the fixing pressure was set at 7 kg/cm$^2$. The weight of each of the developed color toners was set at 7.0 g/m$^2$ in a solid-type image. The weight of the developed transparent toner was set at 7.5 g/m$^2$ in the solid-type image.

The color image thus formed was evaluated as follows:

Fixing strength

The fixing strength was evaluated by folding a solid-type cyan image and rolling a metallic cylinder (100 mm(diameter)×100 mm(length), 1 kg (weight)) thereon to apply pressure, and subsequently, by observing an average omission range in the color image. The criterion for evaluation of the fixing strength will be described below:

○ when the range of omission is less than 0.5 mm

Δ when the range of omission is greater than or equal to 0.5 mm and is also less than 1.5 mm × when the range of omission is greater than or equal to 1.5 mm Evaluation for offset The evaluation for offset was made visually and the criterion for evaluation will be described below.

○ no offset occurs

Δ a small amount of offset occurs

× offset occurs

Evaluation for graininess

The evaluation for graininess was made visually by employing uniform images of 2 cm×2 cm having different average reflection density on 20 evaluators. The evaluation was made based on five steps described below.

1 very coarse-grained 2 coarse-grained 3 ordinary 4 fine-grained 5 very fine-grained Next, the average value of the above-described evaluation was obtained and the graininess was evaluated based on the following criteria.

× when the average value is less than 2

Δ when the average value is greater than or equal to 2 and is also less than 4

○ when the average value is greater than or equal to 4

Evaluation for color reproducibility

The image density of a solid-type magenta image was measured by employing X-rite 404 (manufactured by X-rite) and the evaluation for color reproducibility was made based on the following criteria.

× when the image density is less than 1.2

Δ when the image density is greater than or equal to 1.2 and is also less than 1.6

○ when the image density is greater than or equal to 1.6

Sensory evaluation of image

The sensory evaluation of an entire image was made based on visual observation of a photograph of human figure on 20 evaluators. The sensory evaluation was made at five steps described below.

1 very bad 2 bad 3 ordinary 4 good 5 very fine-grained and excellent

The average value of the above-described evaluation was obtained and the evaluation was made based on the following criteria.

× when the average value is less than 2

Δ when the average value is greater than or equal to 2 and is also less than 4

○ when the average value is greater than or equal to 4

Evaluation for specular glossiness

The measurement of specular glossiness was performed based on a solid-type image and on a cyan image having an image area ratio of 50% by employing Gloss Meter GM-26D (manufactured by Murakami Color Technical Research Institute) and the evaluation for specular glossiness was made based on the following criteria. An incident angle of light on an image was set as 75 degrees.

G1 when the measured value is less than 15

G2 when the measured value is greater than or equal to 15 and is also less than 30

G3 when the measured value is greater than or equal to 30 and is also less than 45

G4 when the measured value is greater than or equal to 45 and is also less than 60

G5 when the measured value is greater than or equal to 60

Evaluation for the difference in glossiness

The difference in glossiness is a difference between the glossiness of a solid-type cyan image and the glossiness of a cyan image having an image area ratio of 50% and was evaluated in accordance with the following criteria.

○ when the difference in glossiness is less than 10

Δ when the difference in glossiness is greater than or equal to 10 and is also less than 20

× when the difference in glossiness is greater than or equal to 20

Further, the evaluation for the used toner material was made as described below.

A rotating flat plate Rheometer RD-2 (manufactured by Rheometrics) was employed for measurement of the viscosity of the toner. The measured temperature was set at the same value as the toner temperature during the actual heat-fixing processing and was compared with a viscosity obtained when the frequency of dynamic viscoelasticity is 0.1 rad/second.

The determination of molecular weight was made by employing gel permeation chromatography. Tetrahydrofuran was used as a solvent. The average particle diameter of the toner was measured by employing a Coulter counter Multisizer II and d50 of average volume was applied thereto.

As for the average particle diameter of the fine particles added to a toner resin, 100 fine particles were photographed by employing a scan-type electron photomicrograph and a value half of the sum of a major axis and a minor axis was obtained for each of 100 fine particles and an average value thereof was employed.

Measurement of impact resilience was conducted in accordance with a process of JIS K6301 impact resilience test.

Measurement of rubber hardness was conducted in accordance with JIS K6301 hardness test and a spring-type hardness test A. The thickness of a sample was set at 12 mm.

[EXAMPLE 1-2]

A color image was formed as in Example 1-1 except that the speed at which the paper pass through the fixing device, i.e., the fixing speed was set at 220 mm/second and the fixing temperature was set at 170° C.

[EXAMPLE 1-3]

A color image was formed as in Example 1-1 except that the pressure applied between the fixing roll and the pressure roll, i.e., the fixing pressure was set at 2 kg/cm$^2$.

[EXAMPLE 1-4]

A color image was formed as in Example 1-1 except that the fixing roll and the pressure roll were each changed as described below and the fixing pressure was set at 2kg/cm$^2$.

Alteration in the fixing roll

An elastic layer formed of silicone rubber and having thickness of 2 mm, impact resilience of 10%, and rubber hardness of 30 degrees was used. Further, no mold release layer was provided thereon.

Alteration in the pressure roll

An elastic layer formed of silicone rubber (foamed) and having thickness of 4 mm, impact resilience of 10%, rubber hardness of 10 degrees was used. Further, no mold release layer was provided thereon.

[EXAMPLE 1-5]

A color image was formed as in Example 1-1 except that an oven fixing device was used as the fixing device and the fixing temperature and the fixing time were set at 180° C. and 10 seconds, respectively.

Evaluation for amount of variation in glossiness

The amount of variation in glossiness was measured based on the four steps of G1 to G4 described above and evaluated based on the following criteria.

○ when the difference in glossiness is greater than or equal to 30

Δ when the difference in glossiness is greater than or equal to 20 and is also less than 30

× when the difference in glossiness is less than 20

[EXAMPLES 2-1 TO 2-5]

A color image was formed as in Examples 1-1 to 1-5 except that the transparent toner A was changed to the following transparent toner B.

Transparent toner B

The transparent toner B contains 93% by volume of a binding resin and 7% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polymethylmethacrylate, average particle diameter is 0.3 μm, refractive index is 1.5). The above-described binding resin and fine particles were grained by employing a jet mill and classified by employing a pneumatic classifier. As a result, the transparent toner B (d50 is 7 μm) was prepared.

The following two types of inorganic fine particles C, D were adhered to 100 parts by weight of the transparent toner B by employing a high-speed mixer. The inorganic fine particle C is silicon dioxide ($SiO_2$), which was prepared in such a manner that the surface thereof is subjected to hydrophobic processing with a silane coupling agent (average particle diameter is 0.05 μm, refractive index is 1.4, amount to be added is 1.1 parts by weight). The inorganic fine particle D is titanium dioxide ($TiO_2$) which was prepared in such a manner that the surface thereof is subjected to hydrophobic processing with a silane coupling agent (average particle diameter is 0.02 μm, refractive index is 2.5, amount to be added is 1.4 parts by weight).

[EXAMPLES 3-1 TO 3-5]

A color image was formed as in Examples 1-1 to 1-5 except that the transparent toner A was changed to the following transparent toner C.

Transparent toner C

The transparent toner C contains 90% by volume of a binding resin and 10% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are silicon dioxide (average particle diameter is 0.012μm, refractive index is 1.4). The above-described binding resin and fine particles were molten and mixed by employing an extruder and grained by employing a jet mill, and further, classified by employing a pneumatic classifier. As a result, the transparent toner C (d50 is 7 μm) was prepared.

The following inorganic fine particle E was adhered to 100 parts by weight of the transparent toner C by employing a high-speed mixer. The inorganic fine particle E is titanium dioxide ($TiO_2$) which was prepared in such a manner that the surface thereof is subjected to hydrophobic processing with a silane coupling agent (average particle diameter is 0.02 μm, refractive index is 2.5, amount to be added is 1.4 parts by weight).

[EXAMPLES 4-1 TO 4-5]

A color image was formed as in Examples 1-1 to 1-5 except that the transparent toner A was changed to the following transparent toner D.

Transparent toner D

The transparent toner D contains 92% by volume of a binding resin and 8% by volume of fine particles. The above-described binding resin is linear polyester obtained from terephthalic acid/bisphenol A ethylene oxide adduct/cyclohexanedimethanol (Tg is 62° C., Mn is 4000, Mw is 35000, refractive index is 1.5). The above-described fine particles are inorganic fine particles (titanium dioxide, average particle diameter is 0.02 μm, refractive index is 2.5). The above-described binding resin and fine particles were molten and mixed by employing an extruder and grained by employing a jet mill, and further, classified by employing a pneumatic classifier. As a result, the transparent toner D (d50 is 7 μm) was prepared.

The following inorganic fine particle F was adhered to 100 parts by weight of the transparent toner D by employing a high-speed mixer. The inorganic fine particle F is silicon dioxide ($SiO_2$), which was prepared in such a manner that the surface thereof is subjected to hydrophobic processing with a silane coupling agent (average particle diameter is 0.05 μm, refractive index is 1.4, amount to be added is 1.1 parts by weight).

[EXAMPLES 5-1 TO 5-5]

A color image was formed as in Examples 1-1 to 1-5 except that the transparent toner A was changed to the following transparent toner E.

Transparent toner E

The transparent toner E contains 75% by volume of a binding resin and 25% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polymethylmethacrylate, average particle diameter is 1.2 μm, refractive index is 1.5). The above-described binding resin and fine particles were molten and mixed by employing an extruder and grained by employing a jet mill, and further, classified by employing a pneumatic classifier. As a result, the transparent toner E (d50 is 7 μm) was prepared.

The following inorganic fine particle was adhered to 100 parts by weight of the transparent toner E by employing a high-speed mixer. The inorganic fine particle is silicon dioxide ($SiO_2$), which was prepared in such a manner that the surface thereof is subjected to hydrophobic processing with a silane coupling agent (average particle diameter is 0.05 μm, refractive index is 1.4, amount to be added is 1.1 parts by weight).

[EXAMPLES 6-1 TO 6-6]

A color image was formed as in Examples 1-1 to 1-5 except that the transparent toner A was changed to the following transparent toner F.

Transparent toner F

The transparent toner F contains 85% by volume of a binding resin and 15% by volume of fine particles. The above-described binding resin is polystyrene/polybutyl acrylate copolymers (mole ratio is 7:3, Tg is 58° C., Mn is 13000, Mw is 31000, refractive index is 1.5). The above-described fine particles are resin-containing fine particles (polystyrene, average particle diameter is 0.05 μm, refractive index is 1.5). The above-described binding resin and fine particles were molten and mixed by employing an extruder and grained by employing a jet mill, and further, classified by employing a pneumatic classifier. As a result, the transparent toner F (d50 is 7 μm) was prepared.

The following two types of inorganic fine particles H, I were adhered to 100 parts by weight of the transparent toner F by employing a high-speed mixer. The inorganic fine particle H is silicon dioxide ($SiO_2$), which was prepared in such a manner that the surface thereof is subjected to hydrophobic processing with a silane coupling agent (average particle diameter is 0.05 μm, refractive index is 1.4, amount to be added is 1.1 parts by weight). The inorganic fine particle I is titanium dioxide ($TiO_2$) which was prepared in such a manner that the surface thereof is subjected to hydrophobic processing with a silane coupling agent (average particle diameter is 0.02 μm, refractive index is 2.5, amount to be added is 1.4 parts by weight).

[EXAMPLES 7-1 TO 7-5]

A color image was formed as in Examples 1-1 to 1-5 except that the transparent toner A was changed to the transparent toner G.

Transparent toner G

The transparent toner G contains 85% by volume of a binding resin and 15% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polystyrene, average particle diameter is 0.05 μm, refractive index is 1.5). The above-described binding resin and fine particles were molten and mixed by employing an extruder and grained by employing a jet mill, and further, classified by employing a pneumatic classifier. As a result, the transparent toner G (d50 is 7 μm) was prepared.

The following two types of inorganic fine particles J, K were adhered to 100 parts by weight of the transparent toner G by employing a high-speed mixer. The inorganic fine particle J is silicon dioxide ($SiO_2$), which was prepared in such a manner that the surface thereof is subjected to hydrophobic processing with a silane coupling agent (average particle diameter is 0.05 μm, refractive index is 1.4, amount to be added is 1.1 parts by weight). The inorganic fine particle K is titanium dioxide ($TiO_2$) which was prepared in such a manner that the surface thereof is subjected to hydrophobic processing with a silane coupling agent (average particle diameter is 0.02 μm, refractive index is 2.5, amount to be added is 1.4 parts by weight).

[Comparative Examples 1-1 To 1-5]

A color image was formed as in Examples 1-1 to 1-5 except that no transparent toner was used.

[Comparative Examples 2-1 To 2-5]

A color image was formed as in Examples 1-1 to 1-5 except that the transparent toner A was changed to the following transparent toner "a".

Transparent toner "a"

The transparent toner "a" contains 97% by volume of a binding resin and 3% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polymethylmethacrylate, average particle diameter is 0.3 μm, refractive index is 1.5). The above-described binding resin and fine particles were molten and mixed by employing an extruder and grained by employing a jet mill, and further, classified by employing a pneumatic classifier. As a result, the transparent toner "a" (d50 is 7 μm) was prepared.

The following inorganic fine particle L was adhered to 100 parts by weight of the transparent toner "a" by employing a high-speed mixer. The inorganic fine particle L is titanium dioxide ($TiO_2$) which was prepared in such a manner that the surface thereof is subjected to hydrophobic processing with a silane coupling agent (average particle diameter is 0.02 μm, refractive index is 2.5, amount to be added is 1.4 parts by weight).

[Comparative Examples 3-1 To 3-5]

A color image was formed as in Examples 1-1 to 1-5 except that the transparent toner A was changed to the following transparent toner "b".

Transparent toner "b"

The transparent toner "b" contains 65% by volume of a binding resin and 35% by volume of fine particles. The above-described binding resin is linear polyester obtained from terephthalic acid/bisphenol A ethylene oxide adduct/cyclohexanedimethanol (mole ratio is 5:4:1, Tg is 62° C., Mn is 4000, Mw is 35000, refractive index is 1.5). The above-described fine particles are resin-containing fine particles (polymethylmethacrylate, average particle diameter is 0.3 μm, refractive index is 1.5).

Results of the above-described examples and comparative examples are shown in Table 1 and Table 2 below.

TABLE 1

| | | gloss-iness 100% | gloss-iness (50%) | fixing prop-erty | off-set | grain-iness | color repro-ducibi-ity | sen-sory evalu-ation | diff-erence in glossi-ness | glossi-glossi-ness (S/W) |
|---|---|---|---|---|---|---|---|---|---|---|
| Ex. 1 | −1 | G5 | G4 | ○ | ○ | ○ | ○ | ○ | ○ | ○ |
| | −2 | G3 | G2 | ○ | ○ | Δ | Δ | Δ | Δ | |
| | −3 | G2 | G2 | ○ | ○ | Δ | Δ | Δ | ○ | |
| | −4 | G2 | G1 | ○ | ○ | ○ | Δ | ○ | ○ | |
| | −5 | G1 | G1 | ○ | ○ | ○ | Δ | ○ | ○ | |
| Ex. 2 | −1 | G5 | G4 | ○ | ○ | ○ | ○ | ○ | Δ | Δ |
| | −2 | G3 | G3 | ○ | ○ | Δ | Δ | Δ | ○ | |
| | −3 | G3 | G3 | ○ | ○ | Δ | Δ | Δ | ○ | |
| | −4 | G2 | G2 | ○ | Δ | Δ | Δ | ○ | ○ | |
| | −5 | G2 | G2 | ○ | ○ | ○ | Δ | ○ | Δ | |
| Ex. 3 | −1 | G5 | G5 | ○ | ○ | ○ | ○ | ○ | ○ | ○ |
| | −2 | G4 | G3 | ○ | ○ | ○ | Δ | Δ | Δ | |
| | −3 | G3 | G3 | ○ | ○ | Δ | Δ | Δ | ○ | |
| | −4 | G3 | G3 | ○ | ○ | ○ | Δ | ○ | ○ | |
| | −5 | G1 | G1 | ○ | ○ | ○ | Δ | ○ | ○ | |
| Ex. 4 | −1 | G5 | G5 | ○ | ○ | ○ | Δ | Δ | ○ | Δ |
| | −2 | G4 | G3 | ○ | ○ | Δ | Δ | Δ | Δ | |
| | −3 | G3 | G3 | ○ | ○ | Δ | Δ | Δ | Δ | |
| | −4 | G2 | G2 | ○ | Δ | Δ | Δ | Δ | ○ | |
| | −5 | G2 | G2 | ○ | ○ | Δ | Δ | Δ | ○ | |
| Ex. 5 | −1 | G4 | G3 | Δ | ○ | Δ | Δ | Δ | ○ | ○ |
| | −2 | G2 | G2 | Δ | Δ | Δ | Δ | Δ | ○ | |
| | −3 | G2 | G2 | Δ | ○ | Δ | Δ | Δ | ○ | |
| | −4 | G1 | G1 | ○ | Δ | Δ | Δ | Δ | ○ | |
| | −5 | G1 | G1 | ○ | ○ | Δ | Δ | Δ | ○ | |
| Ex. 6 | −1 | G4 | G4 | ○ | ○ | Δ | ○ | Δ | Δ | |
| | −2 | G3 | G2 | Δ | Δ | Δ | Δ | Δ | Δ | |
| | −3 | G2 | G2 | Δ | ○ | Δ | Δ | Δ | ○ | |
| | −4 | G1 | G1 | ○ | Δ | Δ | Δ | Δ | ○ | |
| | −5 | G1 | G1 | Δ | ○ | Δ | Δ | Δ | ○ | |
| Ex. 7 | −1 | G5 | G5 | ○ | ○ | ○ | ○ | ○ | ○ | ○ |
| | −2 | G3 | G3 | ○ | ○ | ○ | ○ | ○ | ○ | |
| | −3 | G2 | G2 | ○ | ○ | Δ | Δ | ○ | ○ | |
| | −4 | G2 | G1 | ○ | ○ | ○ | Δ | ○ | ○ | |
| | −5 | G1 | G1 | ○ | ○ | ○ | Δ | ○ | ○ | |

Note: Ex. meΔns ExΔmple.

TABLE 2

| | | gloss-iness 100% | gloss-iness (50%) | fixing prop-erty | off-set | graini-ness | color repro-ducibi-lity | sen-sory evalu-ation | diff-erence in glossi-ness | glossi-ness (S/W) |
|---|---|---|---|---|---|---|---|---|---|---|
| Comp. ex. 1 | −1 | G4 | G2 | ○ | ○ | Δ | ○ | Δ | × | ○ |
| | −2 | G3 | G2 | Δ | ○ | Δ | Δ | Δ | × | |
| | −3 | G2 | G2 | Δ | ○ | Δ | Δ | × | Δ | ○ |
| | −4 | G4 | G2 | ○ | × | ○ | Δ | × | | |
| | −5 | G2 | G2 | ○ | G | × | × | Δ | | |
| Comp. ex. 2 | −1 | G5 | G4 | ○ | × | × | Q | × | ○ | × |
| | −2 | G4 | G3 | ○ | ○ | Δ | ○ | Δ | Δ | |
| | −3 | G3 | G3 | Δ | ○ | Δ | Δ | Δ | ○ | |
| | −4 | G4 | G4 | ○ | × | × | ○ | × | ○ | |
| | −5 | G2 | G2 | ○ | ○ | × | × | Δ | | |
| Comp. ex. 3 | −1 | G3 | G2 | × | ○ | ○ | Δ | Δ | Δ | |
| | −2 | G2 | G1 | Δ | Δ | Δ | Δ | Δ | Δ | |
| | −3 | G2 | G1 | × | × | × | × | × | ○ | × |
| | −4 | G1 | G1 | ○ | ○ | ○ | Δ | Δ | ○ | |
| | −5 | G1 | G1 | ○ | ○ | ○ | × | × | 0 | |

Note: Comp. ex. means Comparative example.

The various problems in the above-described prior art can be solved by the present invention. Further, the present invention can provide a transparent toner, a color image forming method, and a color image forming apparatus, in which graininess, color reproducibility, smoothness, and fixing strength can be sufficiently fulfilled synchronously without being deteriorated and an arbitrary glossiness can be uniformly reproduced on a transfer material without depending on image density.

What is claimed is:

1. A color image forming method comprising at least an image forming step in which a color image formed by a colorless transparent toner with at least one kind of first fine particles of 5 to 30% by volume contained in a binding resin and a color toner is formed on a transfer material and a heat-fixing step in which the color image is heated and fixed on the transfer material, wherein the first fine particles are organic fine particles.

2. A color image forming method according to claim 1, wherein an average particle diameter of the first fine particles is 0.008 to 1 $\mu$M.

3. A color image forming method according to claim 1, wherein an absolute value (ΔN) of a difference in refractive index between the first fine particles and the binding resin is 0.0 to 0.3.

4. A color image forming method according to claim 1, wherein given that an amount of the first fine particles contained in said transparent toner is indicated by R (% by volume) and an average particle diameter of the first fine particles is indicated by d ($\mu$m), the following expression (1) is satisfied:

$$10^{-5} \leqq R \times d^3 \leqq 0.15 \quad (1)$$

.

5. A color image forming method according to claim 1, wherein given that an amount of the first fine particles contained in said transparent toner is indicated by R (% by volume), an absolute value of a difference in refractive index between the first fine particles and the binding resin is indicated by ΔN, and an average particle diameter of the first fine particles is indicated by d ($\mu$m), the following expression (2) is satisfied:

$$0 \leqq \Delta N^2 \times R \times R d^3 \leqq 10^{-6} \quad (2)$$

.

6. A color image forming method according to claim 1, wherein the binding resin is a polyester resin.

7. A color image forming method according to claim 1, wherein the toner further comprises second fine particles externally added to the surface of the transparent toner.

8. A color image forming method according to claim 7, wherein the second fine particles are inorganic fine particles.

9. A color image forming method according to claim 7, wherein the second fine particles are organic fine particles.

10. A color image forming method according to claim 1, wherein the color image is formed by fixing the transparent toner over an entire surface of said transfer material.

11. A color image forming method according to claim 1, wherein the color image is formed by fixing the transparent toner only on portions of said transfer material where said color toner is not fixed.

* * * * *